United States Patent [19]

Sanders

[11] Patent Number: 4,879,774

[45] Date of Patent: Nov. 14, 1989

[54] NESTABLE BED

[76] Inventor: Herbert A. Sanders, 8904 Crosswind Dr., Fort Worth, Tex. 76179

[21] Appl. No.: 145,573

[22] Filed: Jan. 19, 1988

[51] Int. Cl.[4] ..... A47C 19/00/21/00

[52] U.S. Cl. ..... 5/8; 5/131; 5/310; 5/510; 108/91; 297/239

[58] Field of Search ..... 5/8, 310, 509, 510, 5/134, 131; 297/239; 108/91

[56] References Cited

U.S. PATENT DOCUMENTS

| | | | |
|---|---|---|---|
| D. 257,623 | 12/1980 | Bue et al. | 5/510 |
| 2,565,027 | 8/1951 | Jensen | 5/134 |
| 3,460,169 | 8/1969 | Heller | 5/131 |

FOREIGN PATENT DOCUMENTS

| | | | |
|---|---|---|---|
| 130082 | 4/1902 | Fed. Rep. of Germany | 5/131 |
| 993457 | 10/1951 | France | 5/8 |
| 1094893 | 5/1955 | France | 5/8 |
| 1449807 | 7/1966 | France | 5/8 |
| 511554 | 8/1939 | United Kingdom | 297/239 |

*Primary Examiner*—Alexander Grosz

*Attorney, Agent, or Firm*—Hubbard, Thurman, Turner & Tucker

[57] ABSTRACT

Disclosed is a nestable bed. The bed includes a rectangular frame adapted to receive a mattress. The frame has a longitudinal axis and a transverse axis. A pair of first legs are mounted to a first end of the frame with the legs lying in a plane perpendicular to the longitudinal axis. A pair of second legs are mounted on opposite sides of the frame with the second legs lying in spaced apart planes perpendicular to the transverse axis of the frame. The first and second legs are skewed or canted such that substantially identical beds may be nested on top of each other with their sides and ends coincident. Rollers are mounted to the first legs such that the bed may be stood on end and rolled about.

14 Claims, 2 Drawing Sheets

NESTABLE BED

FIELD OF THE INVENTION

The present invention relates generally to beds, and more particularly to a bed that is easily storable in a limited space when it is not in use.

BACKGROUND OF THE INVENTION

A. Description of the Prior Art

In many instances, it is desirable to have beds that are usable on a temporary basis, but which are easily storable when they are not in use. For example, hotels typically keep on hand a number of portable beds. The portable beds are delivered to rooms when the number of fixed beds in the rooms are insufficient. Also, institutions, such as schools or churches, may keep on hand a number of portable beds that can be set up in gymnasiums or the like on a temporary basis.

Most people are familiar with the typical folding or "roll away" bed used in hotels. The roll away bed includes a hinged frame that folds in the middle like a book. The roll away bed frame includes a short central section supported on wheels. The central section has a length about equal to twice the thickness of the mattress. End sections of the frame, which are disposed on either side of the central section, are foldable upwardly along with the mattress. Following the book analogy, the central section corresponds to the spine of a book, with the end sections of the frame corresponding to the covers and the mattress corresponding to the pages. When the roll away bed is folded for transportation and storage, the end portions of the frame are vertically oriented and the folded bed occupies a floor space of approximately the width of the bed times twice the thickness of the mattress.

The presently existing portable beds have a number of shortcomings. For example, such beds are somewhat complex and it takes some skill to fold and unfold them. Also, the constant folding and unfolding of the beds tends to wear them out. Moreover, the folding beds tend not to be as comfortable as normal beds, and their discomfort increases with age; the more times the beds have been folded and unfolded, the more uncomfortable they become. Additionally, the folded beds are unweildy to transport and it is difficult to move around more than one bed at a time. Finally, while the folded bed takes up less floor space than a regular bed, the floor space occupied by the folded bed is not minimized.

It is an object of the present invention to provide a portable storable bed that overcomes the shortcomings of the prior art. More particularly, it is an object of the present invention to provide a portable storable bed that is easily transportable and that occupies a minimum of storage space. It is a further object of the present invention to provide a storage bed that is convertible from its in use position to its stored position quickly and easily. It is a further object of the present invention to provide a relatively inexpensive storable bed that is comfortable to use.

SUMMARY OF THE INVENTION

The foregoing and other objects are accomplished by the bed of the present invention. Briefly stated, the bed of the present invention includes a rectangular frame that is adapted to receive a mattress. The frame defines a plane having a longitudinal axis and a transverse axis. The frame has spaced apart ends that are parallel to the transverse axis and sides that are parallel to the longitudinal axis.

A pair of first legs are mounted to one end of the frame. The first legs lie in a plane perpendicular to the longitudinal axis of the frame. The first legs are non-parallel to each other, and preferably, they are canted or skewed inwardly toward each other.

A pair of second legs is mounted spaced apart from each other on opposite sides of the frame. The second legs lie in spaced apart parallel planes that are perpendicular to the transverse axis of the frame. The second legs are non-perpendicular to the plane defined by the frame. Thus, a plurality of substantially identical such beds are nestable with each other. The nested beds may be stood on end supported by the first legs. Rollers are mounted to the first legs such that the bed may be rolled out when it is stood on end.

DESCRIPTION OF THE PREFERRED EMBODIMENT

Figure 1:
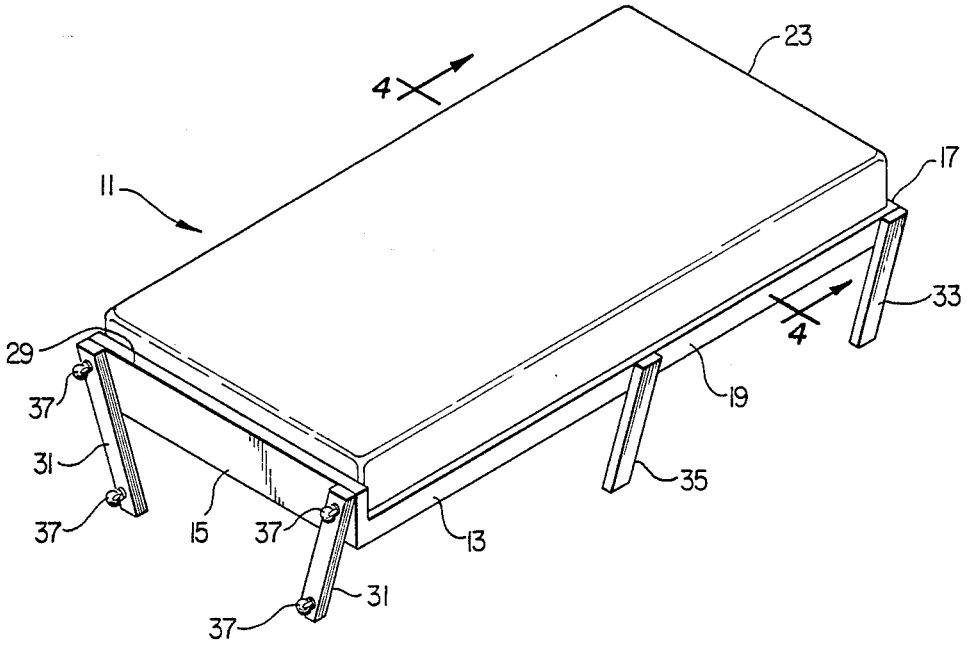
FIG. 1 is a perspective view of a preferred embodiment of the bed of the present invention.
Figure 2:
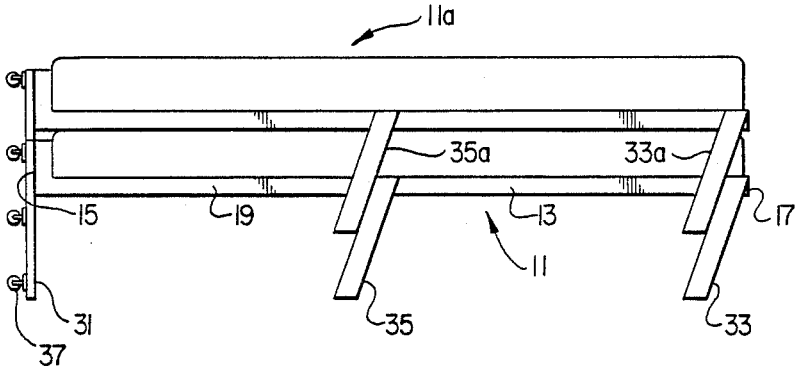
FIG. 2 is a side elevation view of two beds of the embodiment of FIG. 1 in a nested position.
Figure 3:
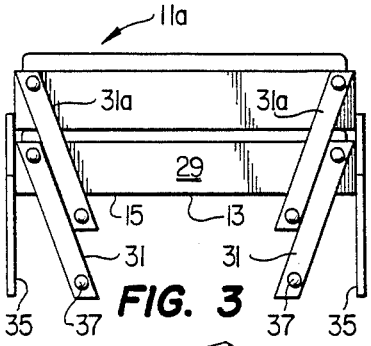
FIG. 3 is an end elevation of the beds of FIG. 2.
Figure 4:
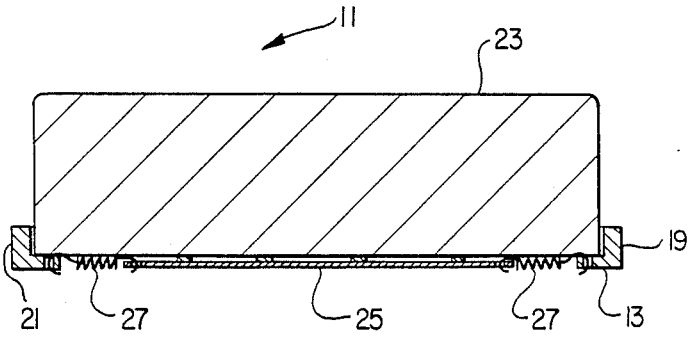
FIG. 4 is a sectional view taken generally along line 4—4 of FIG. 1 showing the support of a mattress in the frame of the bed of FIG. 1.

Referring now to the drawings, and first to FIGS. 1–5, the bed of the present invention is designated generally by the numeral 11. Bed 11 includes a frame 13 having opposed ends 15 and 17 and opposed sides 19 and 21. Frame 13 defines a plane which contains ends 15, and 17 and sides 19 and 21. The plane of frame 13 has a longitudinal axis parallel to sides 19 and 21 and a transverse axis parallel to ends 15 and 17. Frame 13 can be made of any material having adequate strength. Common materials such as steel, aluminum, wood, or plastic composites may be used. Ends 15 and 17 and sides 19 and 21 are preferably of an L-shaped configuration, as shown in FIG. 4, and they are adapted to receive and support a mattress 23. Referring particularly to FIG. 4, a wire or band support assembly or mattress deck 25 is strung within frame 13 by means of springs 27. The first end 15 of frame 13 may be enlarged to form a headboard 29.

Frame 13 is supported in its horizontal or normal in use position by a plurality of legs. The legs include a pair of first legs 31 mounted to the first end 15 of frame 13. As best shown in FIG. 2, first legs 31 lie in a plane perpendicular to the longitudinal axis of frame 13. As is best shown in FIG. 3, first legs 31 are nonparallel to each other and, in the preferred embodiment, they are skewed or canted inwardly toward each other from their respective points of attachment to first end 15.

A pair of second legs 33 are mounted to frame 13 on sides 19 and 21. Legs 33 lie in spaced apart planes perpendicular to the transverse axis of frame 13 and they are nonperpendicular to the plane defined by frame 13. In the preferred embodiment, legs 33 are parallel to each other and they are canted toward first end 15 of frame 13.

A pair of third legs 35 are also connected to sides 19 and 21 of frame 13. Legs 35 lie in spaced apart planes perpendicular to the transverse axis of frame 13 and they are parallel to each other. In the embodiment of FIGS. 1–5, second legs 33 and third legs 35 are parallel to each other. The third legs 35 provide support to the middle of bed 11.

Figure 5:
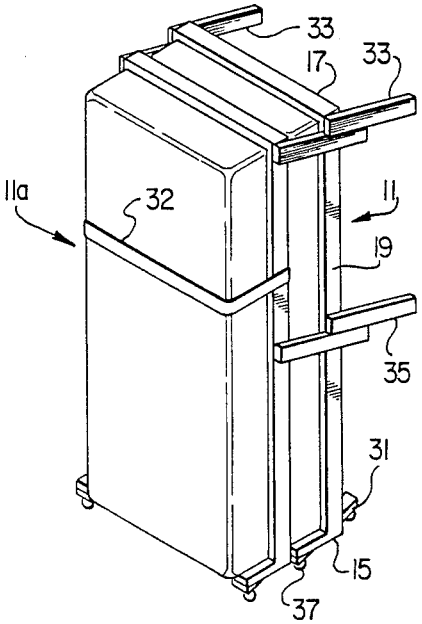
FIG. 5 is a perspective view of the nested beds of FIGS. 2 and 3 stood on end.

The legs 31, 33, and 35 are canted at angles such that substantially identical beds 11 are nestable with their ends and sides coincident and their respective mattresses 23 in close proximity to each other, as shown in FIGS. 2, 3 and 5. The height of legs 31, 33, and 35 is greater than the thickness of mattress 23 so that a nested bed straddles the bed beneath it. Referring particularly to FIG. 3, first legs 31*a* of a second bed 11*a* mate with legs 31 of bed 11 to provide lateral stability to the nested beds. Also, second legs 33*a* and third legs 35*a* of the second bed 11*a* straddle sides 19 and 21 of the first bed 11 when they are nested to provide further lateral stability. While in the embodiment of FIGS. 1–3, first legs 31 are canted inwardly toward each other, those skilled in the art will recognize that first legs 31 could be canted outwardly with respect to each other. Similarly, second legs 33 and third legs 35 are canted toward first end 15, but they could, within the spirit of the invention, be canted away from first end 15 or they could be canted toward each other.

First legs 31 each have mounted thereto a pair of rollers 37. Rollers 37 are mounted on the outboard surfaces of first legs 31 and their rolling surfaces define a plane that is perpendicular to the longitudinal axis of frame 13. Rollers 37 are adapted to contact and support bed 11 on a horizontal surface when bed 11 is stood on end, as shown in FIG. 5. Thus, when bed 11 is stood on end, it is readily transportable across a floor on rollers 37. In the embodiment of FIGS. 1–5, rollers 37 are ball casters, but those skilled in the art will recognize alternative forms of roller.

As shown in FIG. 5, beds 11 and 11*a* are readily nestable in the vertical position. It can be visualized that any number of similar beds may be so nested. When nested, due to the engagement and mating relationship of the legs, the beds form a substantially unitary structure that is movable about as a unit. As shown in FIG. 5, a strap 32 may be provided about frame 13 and mattress 23 of the outermost bed 11*a* to keep the mattress from falling out of the frame in the vertical position.

As best shown in FIGS. 2 and 3, the legs of bed 11*a* are nested with those of bed 11. Thus, the legs of nested beds do not add to the floor space required to accommodate the nested beds stood on end. Each additional bed requires only an amount of floor space substantially equal to the width of bed 11 times the thickness of the mattress. A number of beds 11 may thus be conveniently stored nested in the on end position in a closet or the like and occupy a floor space equal only to the number of beds times the thickness of the mattress times the width of the bed plus the height of one set of legs.

Figure 6:
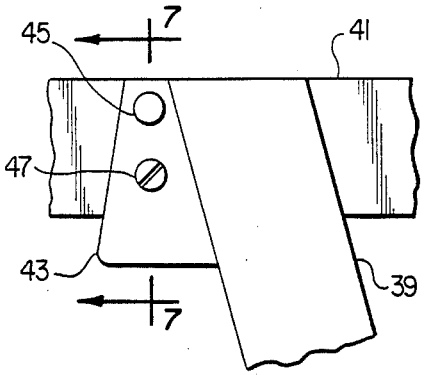
FIG. 6 is a partial elevation view showing an alternative connection of a leg and frame of the present invention.
Figure 7:
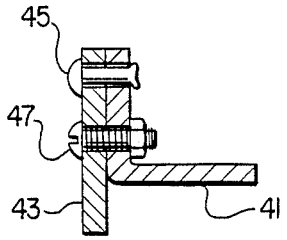
FIG. 7 is a sectional view taken generally along line 7—7 of FIG. 6 showing further details of the connection of the leg and frame.

In the embodiment of FIGS. 1–5, the legs are rigidly attached to frame 13 as, by welding. In FIGS. 6 and 7, there is shown an alternative arrangement for connecting a leg 39 to a frame 41. Frame 41 is fabricated from angleiron and leg 39 includes a trapezoidal tab 43. Tab 43 is pivotally connected to frame 41 by a rivet 45. Tab 43 may be fixed to frame 41 by a bolt 47. A bed with leg connections as shown in FIGS. 6 and 7 may be shipped to a purchaser in a knocked down condition with bolts 47 removed. The customer would assemble the bed by pivoting leg 39 with respect to frame 41 and appropriately fastening bolt 47. After assembly, the bed would be substantially identical in appearance and operation to the that shown in FIGS. 1–5.

Figure 8:
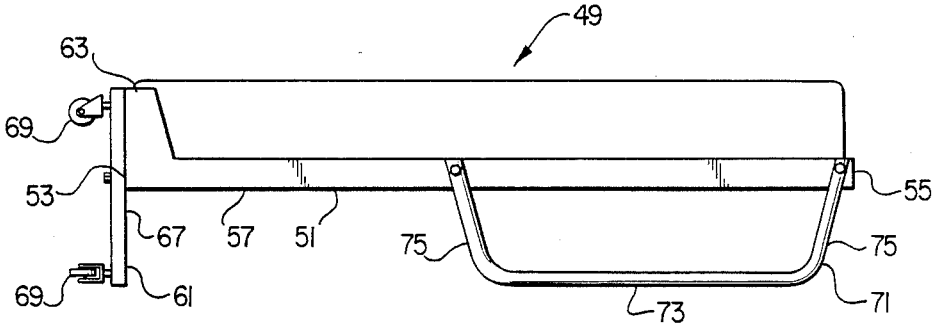
FIG. 8 is a side elevation view of an alternative embodiment of the bed of the present invention.
Figure 9:
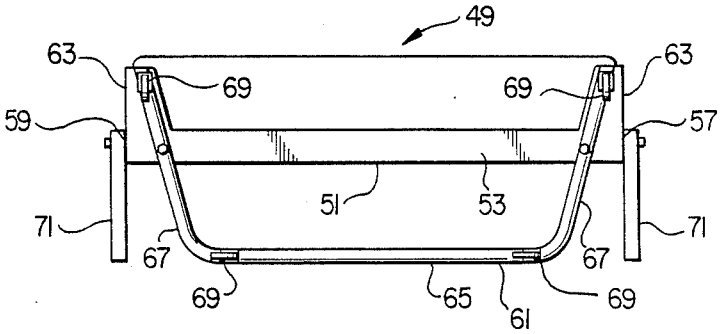
FIG. 9 is an end elevation of the bed of FIG. 8.

Referring to FIGS. 8 and 9, there is shown an alternative embodiment of the bed of the present invention, which is designated generally by the numeral 49. Bed 49 includes a rectangular frame 51 having opposed ends 53 and 55 and sides 57 and 59. Frame 51 is conveniently made of angleiron.

The first legs of alternative bed 49 are formed by a generally U-shaped member 61 connected by bolts or the like to gussets 63 formed at first end 53. U-shaped member 61 includes a base portion 65 and upwardly and outwardly flaring leg portions 67. U-shaped member 61 is preferably formed from a square cross-sectioned tube. U-shaped member 61 lies in a plane perpendicular to the longitudinal axis of frame 51 and it is connected to first end 53 of frame 51 by the bolts or the like. A plurality of rollers, which take the form of casters 69 are mounted to the outboard end of U-shaped member 61 so that bed 49 may be rolled about when it is stood on end.

The second and third legs of bed 49 are formed by generally U-shaped members 71 connected by bolts or the like to sides 57 and 59 of frame 51. U-shaped members 71 each include a base portion 73 and upwardly and outwardly flaring leg portions 75. U-shaped members 71 lie in spaced apart planes perpendicular to the transverse axis of frame 51. Beds of the type shown in FIGS. 8 and 9 are nestable in the same way as those of FIGS. 1–5.

The construction of bed with U-shaped members 61 and 71 allows for the legs to be of lighter weight than the legs of FIGS. 1–5 without sacrificing strength or rigidity. Also the U-shaped members 17 form convenient handles to use when lifting bed 49 to the on end position.

It can be seen that the bed of the present invention is not only well adapted for use as a normal bed but also it is easily storable in a compact floor space. The bed is moved to its storable position simply by standing it on end. With the bed stood on end it can be rolled about and through doors and around corners with a minimum of effort. Multiple beds may be nested together and they may be stored in their nested configuration.

Further modifications and alternative embodiments of the apparatus and method of this invention will be apparent to those skilled in the art in view of this description. Accordingly, this description is to be construed as illustrative only and is for the purpose of teaching those skilled in the art the manner of carrying out the invention. It is to be understood that the forms of the invention herewith shown and described are to be taken as the presently preferred embodiments. Various changes may be made in the size, shape and arrangement of parts. For example, equivalent elements or materials may be substituted for those illustrated and described herein, parts may be reversed, and certain features of the invention may be utilized independently of the use of other features, all as would be apparent to one skilled in the art after having the benefit of this description of the invention.

What is claimed is:

1. A set of beds, which comprises:

a plurality of rectangular frames, each of said frames being adapted to receive a mattress, each frame defining a plane having a longitudinal axis and a transverse axis;

a pair of first legs mounted to a first end of each frame, said first legs lying in a plane perpendicular to said longitudinal axis, said first legs being unparallel to each other;

a pair of second legs mounted spaced apart from each other on opposite sides of each frame, said second legs lying in spaced apart planes perpendicular to said transverse axis, said second legs being nonperpendicular to the plane defined by said frame;

and a mattress carried by each of said frames;

wherein said frames are stacked on top of each other with their ends and sides coincident with each other and their mattresses in close proximity to each other.

2. The set of beds as claimed in claim 1, wherein:

said first legs are skewed inwardly toward each other from their respective points of attachment to said frame.

3. The set of beds as claimed in claim 2, including a base member interconnecting the ends of said first legs opposite their points of attachment to said frame, said base member being parallel to said transverse axis.

4. The set of beds as claimed in claim 1, wherein said second legs are parallel to each other.

5. The set of beds as claimed in claim 1, including a pair of third legs mounted spaced apart from each other on opposite sides of said frame intermediate said first and second legs, said third legs lying in spaced apart planes perpendicular to said transverse axis, said third legs being nonperpendicular to said plane defined by said frame.

6. The set of bed as claimed in claim 5, wherein:

said second legs are parallel to each other;

and said third legs are parallel to each other.

7. The bed as claimed in claim 6, wherein said second and third legs are parallel to each other.

8. The set of beds as claimed in claim 6, wherein said second and third legs are skewed inwardly toward each other from their respective points of attachment to said frame.

9. The set of beds as claimed in claim 8, including base members interconnecting the ends of said second and third legs opposite their points of attachment to said frame, said base members being parallel to said longitudinal axis.

10. The set of beds as claimed in claim 1, including at least two rollers mounted to each of said first legs, said rollers lying in a plane perpendicular to said longitudinal axis and extending outwardly from said legs whereby said frame may be stood and rolled about on end with said longitudinal axis in a vertical orientation.

11. The bed as claimed in claim 1, wherein said first and second legs are pivotally mounted to said frame.

12. The set of beds as claimed in claim 1, wherein said pair of first legs is defined by a generally U-shaped member including a base portion and spaced apart leg portions extending upwardly and outwardly from said base portion.

13. The set of beds as claimed in claim 12, including roller means mounted to said generally U-shaped member for movably supporting said frame with said longitudinal axis in a vertical orientation.

14. The set of beds as claimed in claim 12, wherein said second legs are each defined by a generally U-shaped member including a base portion and spaced apart leg portions extending upwardly and outwardly from said base portion.

* * * * *